US005116138A

United States Patent [19]

Macsenti et al.

[11] Patent Number: 5,116,138

[45] Date of Patent: May 26, 1992

[54] FLEXIBLE, COLLAPSIBLE CONTAINER

[75] Inventors: Ronald J. Macsenti; Frederick M. Avery, both of Phoenix, Ariz.

[73] Assignee: The Niven Marketing Group, Des Plaines, Ill.

[21] Appl. No.: 557,402

[22] Filed: Jul. 23, 1990

[51] Int. Cl.[5] ..... B65D 33/02

[52] U.S. Cl. ..... 383/33; 248/99; 220/9.2

[58] Field of Search ..... 383/12, 16, 22, 33, 383/13, 23; 248/99; 56/473.5; 220/9.1, 9.2; 206/44 R

[56] References Cited

U.S. PATENT DOCUMENTS

| | | | |
|---|---|---|---|
| 288,654 | 11/1883 | Morse | 220/9.2 |
| 332,226 | 12/1885 | Brailey | 248/99 |
| 1,078,083 | 11/1913 | Blood | 248/99 |
| 1,577,298 | 3/1926 | Roeller | 383/33 X |
| 2,315,001 | 3/1943 | Logan | 220/9.2 X |
| 2,458,797 | 1/1949 | Prag | 220/9.2 X |
| 2,509,537 | 5/1950 | Stier | 383/12 X |
| 3,155,356 | 11/1964 | Montgomery | 248/99 |
| 3,695,565 | 10/1972 | Hodges | 248/99 X |
| 3,838,839 | 10/1974 | Spencer | 248/99 |
| 4,550,440 | 10/1985 | Rico | 383/33 |

*Primary Examiner*—Stephen P. Garbe
*Assistant Examiner*—Jes F. Pascua
*Attorney, Agent, or Firm*—Wallenstein, Wagner & Hattis, Ltd.

[57] ABSTRACT

A container for support along a vertical surface, and comprising front and back walls, side walls, and a bottom wall, all made of a flexible plastic. The container has an open top end for the insertion and removal of goods to be displayed. The container also includes an upper rim providing support for and along the upper ends of the front, back, and side walls. A bottom rod has a pair of spaced apart ends, and circumscribes one or more of the back and side walls.

4 Claims, 2 Drawing Sheets

FLEXIBLE, COLLAPSIBLE CONTAINER

TECHNICAL FIELD

The present invention relates to a flexible and collapsible container for the storage of goods, especially for small individually wrapped or packaged goods.

BACKGROUND OF THE INVENTION

The manufacturers of various pre-packaged products are constantly seeking to obtain a marketing edge over their rivals. Novel merchandising display bins or racks are but one way of gaining such an edge. Many of the prior and existing merchandising display bins are made of an opaque material. As a result, the consumer has a more difficult time in seeing the displayed merchandise from across the room of the retail establishment. This is a serious drawback, as point of purchase displays which show the trade dress of a product are believed to encourage profitable impulse sales.

Other prior merchandising display bins are transparent, overcoming this obstacle, but are relatively heavy because they are made of a molded, rigid plastic. Such display bins not only add to the weight of the product, but also prevent the bin from being stored away in a relatively compact form.

The prior art known to the inventors includes U.S. Pat. No. 3,187,924, issued to William Marcus on Jun. 8, 1965, entitled "CONTAINERS." This patent claims and describes a container for insertion into an apertured board, such as a peg board. Marcus does not disclose the use of soft and flexible vinyl in connection with a container, but rather discloses a rigid, walled container which is "molded from plastic." See column 2, lines 43–49.

From a review of its specification, it appears that Marcus is directed to a novel means of securing that container to the wall. This novel means includes upper spaced projections 20 which extend rearwardly from the rigid back wall of the container. That back wall also includes a second set of spaced projections 26 which, together with first spaced projections, enable the container to be secured to the wall. Nothing in Marcus appears to suggest soft vinyl or other flexible walls for the container.

U.S. Pat. No. 3,501,015, issued to Paul E. Behles on Mar. 17, 1970, is entitled "DISPLAY DEVICE FOR PACKAGED MERCHANDISE." This patent does not claim a bin at all. Rather, it discloses a merchandising display system for holding and displaying packaged goods. These packaged goods, such as boxes or other similar prepackaged articles (FIG. 1), are retained between and supported by a pair of package-supporting arms. These arm-like projections can retain only packages of a predetermined size, that is, packages of substantially the same length.

U.S. Pat. No. 3,502,294, issued to W. H. Kalbow et al. on Mar. 24, 1970, is entitled "MOUNTING ASSEMBLY." Although this patent shows a container in its FIGS. 1 and 2, that container is not made of a flexible vinyl or other similar material. Rather, the invention is directed to an anchor (see FIGS. 3, 4, 5 and 6) for securing an article onto an apertured board.

U.S. Pat. No. 3,595,404, issued to Arthur Goldstein et al. on Jul. 27, 1971, is entitled "SHELF." The appearance and purpose of the Goldstein invention are generally similar to that of the Behles invention discussed above. As may be seen in FIG. 1, however, the invention includes provision for up to six rows of the books or other similar articles which may be held by that shelf. Goldstein neither discloses nor suggests a bin including a soft vinyl plastic, nor does it suggest the manufacture of such a bin having collapsible features.

U.S. Pat. No. 4,154,356, issued to Edmund H. Schieve on May 15, 1979, is entitled "MODULAR CONTAINER." Schieve discloses a modular container which is made for mounting to an apertured board. The container itself has a front and rear wall, but it does not appear that any of the walls are made of a flexible vinyl. In fact, the container 10 disclosed is said to be of a "transparent plastic such as polystyrene." See column 3, lines 6–7. From a review of FIGS. 2 and 3, it is apparent that the polystyrene used for these containers is rigid. Moreover, the structures described in these figures must be rigid. In particular, at column 4, lines 11–15, it is disclosed that the edge 68 of lid 66 is rounded and shaped so that it can be forced into pivot 62. If the lid 66 were made of a flexible vinyl, there would be no need to shape and round the ends of that lid in order to force it into pivot 62. Finally, wall 22 of the container is obviously self-supporting, as may be seen in FIGS. 2 and 3. That wall could not support itself structurally in the manner shown unless it were rigid.

U.S. Pat. No. 4,248,352, issued to Elzie T. White on Feb. 3, 1981, is entitled "WIRE POCKET DISPLAY DEVICE." The device claimed in this patent is again very similar to the above-described wire display racks of Behles and Goldstein. It is intended to retain objects of generally regular and rectangular shapes, as may be seen in FIG. 2.

U.S. Pat. No. 4,322,006, issued to Howard J. Marschak on Mar. 30, 1982, is entitled "DISPLAY UNIT MOUNTING MEANS." This patent discloses a display unit for use with an apertured support, such as a peg board, and for displaying a plurality of objects. FIGS. 2 and 4, and the description of their features including their wall portions 61 and 62, clearly show that the walls of the unit's container are rigid. The container is described as having "upstanding front, rear and side walls." This patent does not disclose containers manufactured of a flexible vinyl.

U.S. Pat. No. 4,542,832, issued to Harold N. Minick et al. on Sep. 24, 1985, is entitled "STORAGE ACCESSORIES FOR MOVABLE PARTITION SYSTEMS." The Minick invention discloses accessories for suspension from beams mounted on either space divider panels or a stand. At the right-hand side of FIG. 1, the Minick reference discloses "a pocket forming, flexible web 54 (that) can be suspended between the back and front lateral members of the frame 46 to form (a) pouch-like accessory 60." This device is not, however, a bin of any sort. It does not include side walls which would retain articles within the bin upon movement of those articles to the right or left. Rather, the web of the Minick invention merely provides support for articles.

SUMMARY OF THE INVENTION

The invention is a container for support along a generally vertical surface, and comprises front and back walls, side walls, and a bottom wall, all made of a flexible plastic. The container has an open top end for the insertion and removal of goods to be displayed. The container also includes an upper rim providing support for and along the upper ends of the front, back, and side walls. A bottom rod has a pair of spaced apart ends, and circumscribes one or more of the back and side walls.

In the first version of the container, which may be used as a candy bin, the bin is made of a vinyl material. The rectangular opening at the top of the bin permits access to its contents, and the transparent vinyl permits one to view those contents from many angles. A vinyl or other similar sleeve joins the ends of the bottom rod and the upper rim, and the sleeve permits those adjacent rod and rim to be swiveled relative to each other. This construction also permits the bin to be collapsed, permitting easy shipment.

The vinyl bins of the invention are far more lightweight than the molded plastic bins of the prior art. In addition, the flexible vinyl construction enables these bins to be cleaned much more easily than such prior molded plastic bins. Projections at the top of the bins permit the insertion of those bins into conventional slat walls The second embodiment of the invention has a slightly different projection for insertion into slat walls. That projection is flat, and more tab-like. In addition, the second version has a rigid junction between the ends of the bottom rod and the rigid rim. In most other important aspects, the two containers are similar.

DETAILED DESCRIPTION OF THE PREFERRED EMBODIMENT

Figure 1:
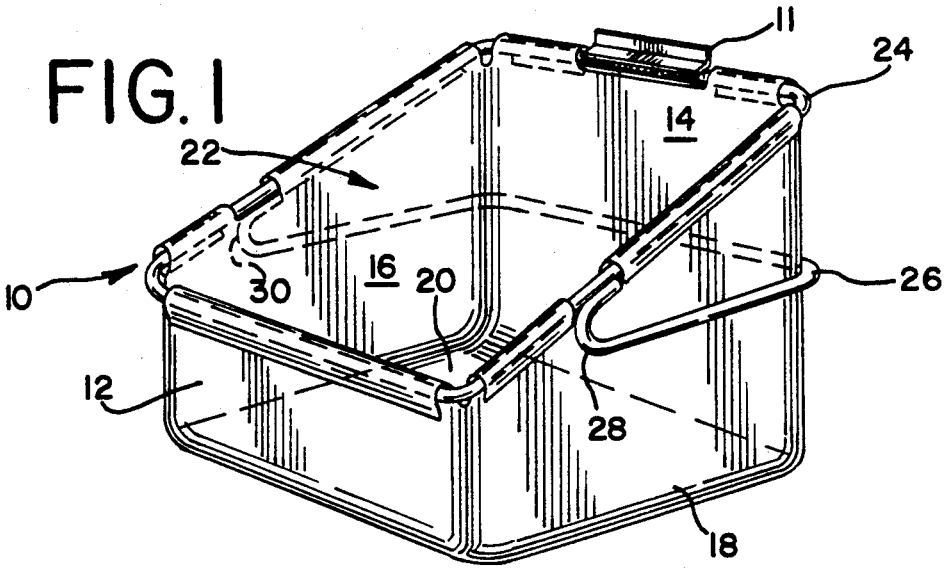
FIG. 1 is a perspective view of one embodiment of the container of the present invention.
Figure 2:
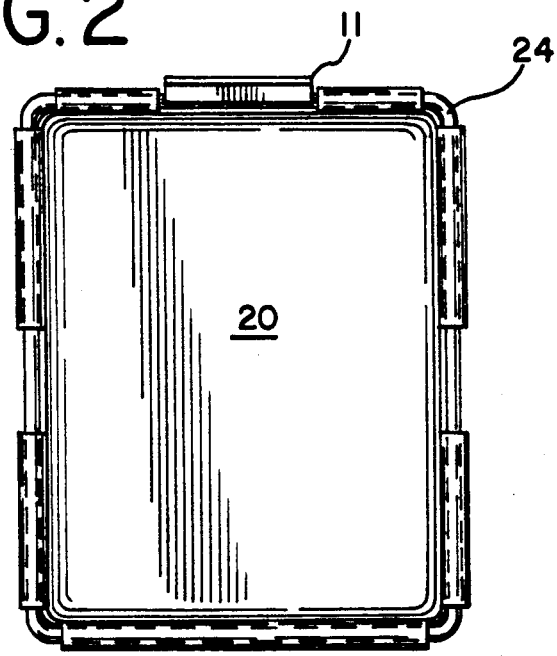
FIG. 2 is a top view of the container of FIG. 1.
Figure 3:
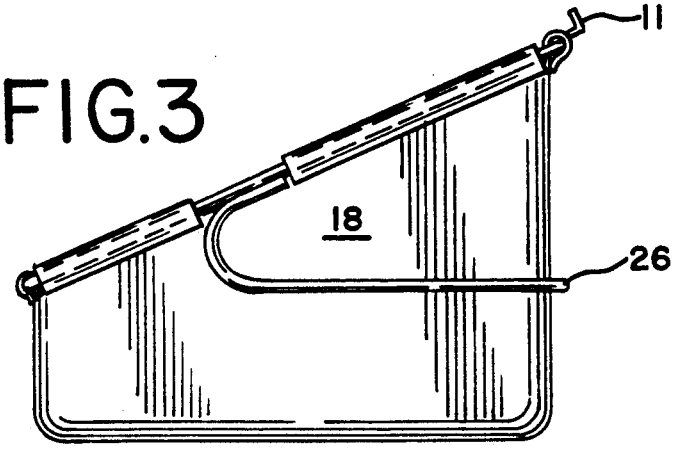
FIG. 3 is a side view of the container of FIG. 1.

One embodiment of the present invention is shown in FIGS. 1-3 of the drawings. That embodiment of the invention is a container 10 for support along a vertical surface (not shown), such as a slat wall, a conventional building wall, or a display column having a suitable vertical surface. Slat walls are conventional, and include apertures for engagement by a complementary tab 11 which is inserted into one of those apertures.

The container itself includes a front wall 12 and a spaced-apart and generally parallel back wall 14. This front 12 and back wall 14, along with two side generally parallel side walls 16 and 18, are interconnected with a bottom wall 20. Each of these five walls are preferably made of a flexible and transparent, 0.010–0.015 inch gauge vinyl or other plastic material. The walls may be either formed of one piece of this transparent vinyl, as is preferred or secured together from several pieces by a heat-sealing or any other suitable method. In any event, the walls should be sealed to each other in a manner that will prevent articles from inadvertently falling out of that container.

This container 10 has an open top end 22 for the insertion and removal of the goods to be displayed. For example, the container 10 may be used for the display of boxed individual candy servings, candy bars, or small carded or heat-sealed products. The goods are placed into the container through this open top end 22. The transparent side, top, and rear walls permit the potential consumer to view the goods in their trade dress, stimulating demand. In addition, the merchant can know at a glance whether the container needs restocking.

The container also includes an upper rim 24. In this embodiment, this rim 24 is made of an elongated tubular metal section. As may be seen in FIG. 1, this rim 24 extends downwardly, at an angle of approximately 20–35 degrees, from an upper position adjacent the rear wall 14 to a lower position adjacent the front wall 12. The tab 11 for the slat wall is fixedly secured to this tubular rim 24.

The rim 24 also provides support for the front 12, back 14, and side walls 16 and 18, at their respective upper ends. These walls are each secured to that rim 24 by wrapping a portion of those upper ends around that rim 24, and then heat-sealing the overlapping plastic.

The invention also includes a bottom rod 26 made of this same tubular metal. In the most preferred embodiment, this bottom rod 26 has a pair of spaced apart ends 28 and 30. In this embodiment, these ends 28 and 30 are generally C-shaped. The bottom rod 26 circumscribes, i.e., extends around, one or more of the back 14 and side walls 16 and 18. In the embodiment shown in FIGS. 1-3, this bottom rod 26 circumscribes the back wall 14, and approximately the most rearward two-thirds of the side walls 16 and 18.

In the preferred embodiment of FIG. 1, the C-shaped portions 28 and 30 at the ends of the bottom rod 26 are fixedly secured to the upper rim 24. In this way, the container is rigid, yet lightweight.

Figure 5:
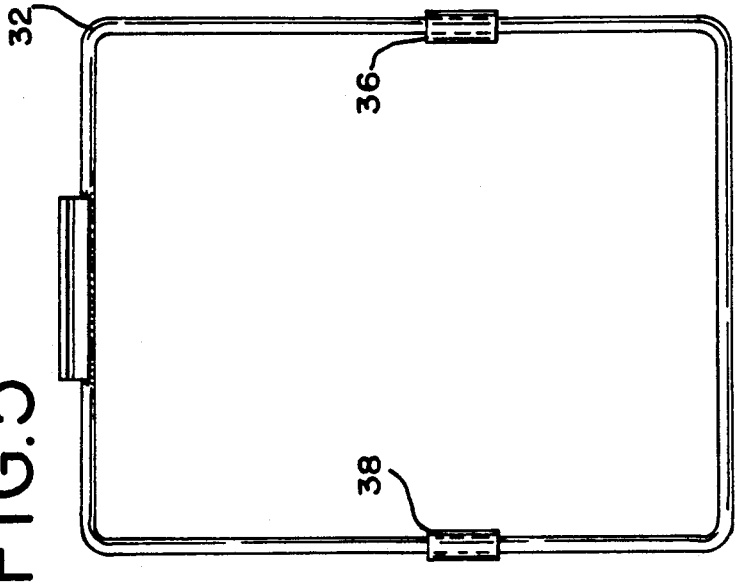
FIG. 5 is a top view of the container of FIG. 4.
Figure 4:
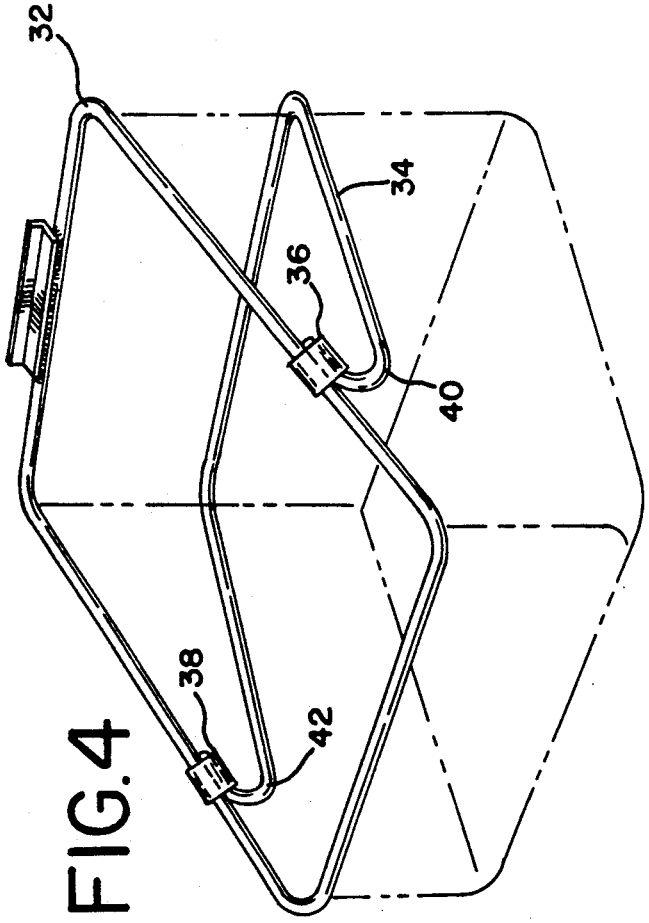
FIG. 4 is a perspective view of a second embodiment of the container of the present invention.
Figure 6:
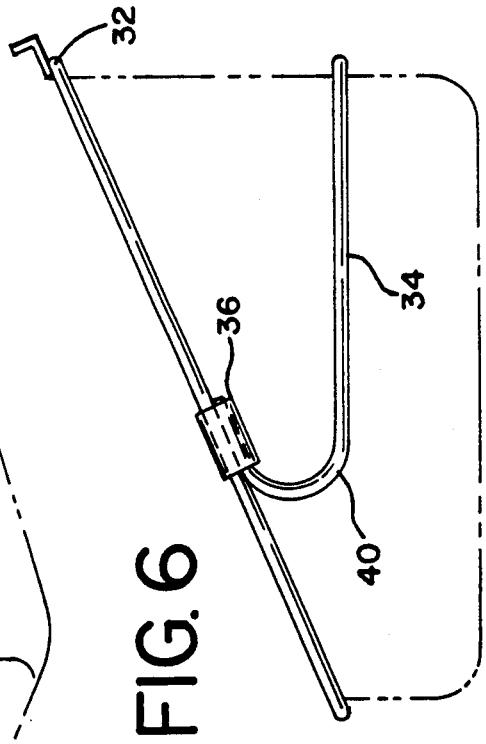
FIG. 6 is a side view of the container of FIG. 4.

In yet another embodiment, shown in FIGS. 4-6, the ends of the bottom rod may instead be non-fixedly secured to the upper rim. In this embodiment, the upper rim 32 is pivotally secured to the bottom rod with a pair of sleeves 36 and 38. Each of these sleeves is preferably formed of vinyl, and each tightly surrounds and envelops a straight portion of the upper rim 32 and a part of the curved, C-shaped portion 40 and 42 of the bottom rod 34.

In the embodiment of FIGS. 4-6, the bottom rod 34 and the upper rim 32 are pivotable adjacent and along the sleeves 36 and 38. Essentially, the upper rim 32 and bottom rod 34 overlay each other upon such pivoting. Because of the flexibility of the vinyl material used in these containers, the entire container may be collapsed upon pivoting of the bottom rod 34 relative to the upper rim 32.

It will be understood by those skilled in the art that the C-shaped ends of the bottom rods in these two embodiments need not meet the upper rim at the locations shown in the drawings. For example, one embodiment may include a C-shaped end joining the upper rim, in either fixed or pivotable fashion, at a point adjacent the front wall of the container.

While the specific embodiments have been illustrated and described, numerous modifications come to mind without markedly departing from the spirit of the invention. The scope of protection is thus only intended to be limited by the scope of the accompanying Claims.

What we claim is:

1. A container for support along a vertical surface, said container comprising front and back walls, and side walls, each of said front, back and side walls having upper ends, and a bottom wall; said container having an open top end for the insertion and removal of goods to be displayed in said container; said walls of said container being made of a transparent, flexible plastic; and said container further comprising an upper rim providing support for and along the upper ends of said front, back and side walls; and a bottom rod having a pair of spaced apart ends, and circumscribing at least one of said back and side walls, said bottom rod including a C-shaped portion at its ends for fixed securement of said ends to said upper rim.

2. The container as set forth in claim 1, wherein the ends of said bottom rod are movably secured to said upper rim with a pair of sleeves, and wherein said bottom rod and said upper rim are pivotable adjacent and along said sleeve to permit the collapsing of said container.

3. A container, said container comprising front and back walls, and side walls, each of said front, back and side walls having upper ends, and a bottom wall; said container having an open top end for the insertion and removal of goods to be displayed in said container; said walls of said container being made of a flexible, transparent plastic; and said container further comprising an upper rim providing support for and along the upper ends of said front, back and side walls; and a bottom rod having a pair of spaced apart ends, and circumscribing at least one of said back and side walls, said bottom rod including a C-shaped portion at its ends for fixed securement of said ends to said upper rim.

4. The container as set forth in claim 3, wherein the ends of said bottom rod are movably secured to said upper rim with a pair of sleeves, and wherein said bottom rod and said upper rim are pivotable adjacent and along said sleeves to permit the collapsing of said container.

* * * * *